US005749537A

United States Patent [19]

Muzio, Jr. et al.

[11] Patent Number: 5,749,537

[45] Date of Patent: May 12, 1998

[54] METHOD OF WRAPPING CRYOGENIC INSULATION AROUND AN INNER CRYOGENIC TANK

[75] Inventors: Joseph R. Muzio, Jr., Latham; Kenneth James McGivern, Sr., Cohoes, both of N.Y.

[73] Assignee: Lydall, Inc., Manchester, Conn.

[21] Appl. No.: 554,719

[22] Filed: Nov. 7, 1995

[51] Int. Cl.[6] ..... B65H 81/00

[52] U.S. Cl. ..... 242/439.5; 242/160.2; 242/441

[58] Field of Search ..... 242/436, 439.5, 242/441, 160.2, 160.4

[56] References Cited

U.S. PATENT DOCUMENTS

| | | | |
|---|---|---|---|
| 2,070,925 | 2/1937 | Rolfs et al. | 242/439.5 |
| 2,275,858 | 3/1942 | Mallard | 242/439.5 |
| 2,555,205 | 5/1951 | Steffens | 242/160.2 |
| 2,657,866 | 11/1953 | Lungstrom | 242/439.5 |
| 3,015,385 | 1/1962 | Chestnut | 242/160.2 |
| 3,341,004 | 9/1967 | Hoeglund | 242/160.2 |
| 3,785,483 | 1/1974 | Sillay | 242/160.4 |
| 4,069,359 | 1/1978 | DeMarse et al. | 242/160.2 X |
| 4,346,550 | 8/1982 | Ferree | 242/439.5 X |
| 4,610,403 | 9/1986 | Goekler et al. | 242/439.5 |
| 5,149,590 | 9/1992 | Arthur et al. | 428/421 |

FOREIGN PATENT DOCUMENTS

| | | | |
|---|---|---|---|
| 1254449 | 11/1971 | United Kingdom | 242/441 |

*Primary Examiner*—Daniel P. Stodola
*Assistant Examiner*—Emmanuel M. Marcelo
*Attorney, Agent, or Firm*—Griffin, Butler, Whisenhunt & Kurtossy

[57] ABSTRACT

A method of wrapping cryogenic insulation around an inner tank disposable within an outer tank of a cryogenic tank system, where cryogenic insulation paper is unrolled from a roll thereof, wrapping the paper in serially disposed wraps around the inner tank, unrolling cryogenic insulating metal foil from a roll thereof and wrapping the foil in serially disposed wraps onto respective serial wraps of the paper. In the method there is utilized at least one combined roll of cryogenic insulation having alternating combined layers of the paper of a defined first width and foil of a defined second width wherein the defined second width is less than the defined first width and the foil is centered on the paper so as to provide edge portions at each edge of the paper which are not contacted by the foil. Lengths of combined layers are unrolled from the combined roll, and the lengths of combined layers are serially wrapped around the inner tank.

20 Claims, 4 Drawing Sheets

METHOD OF WRAPPING CRYOGENIC INSULATION AROUND AN INNER CRYOGENIC TANK

The present invention relates to a method of wrapping cryogenic insulation around an inner tank of a cryogenic tank system, a combined roll of cryogenic insulation for use in such method, a method of producing the combined roll of cryogenic insulation, and an apparatus for producing the combined roll of cryogenic insulation.

BACKGROUND OF THE INVENTION

As is well known in the art, cryogenic tank systems have an inner tank disposed within an outer tank for creating a space therebetween such that a vacuum can be maintained between the inner and outer tanks for insulation purposes. While the outer tank may be insulated in a variety of conventional fashions, the inner tank is wrapped with cryogenic insulation.

That cryogenic insulation is comprised of two elements. The first element is referred to in the art as a "paper" but, in fact, is made of a fibrous felt-like material. That fibrous felt-like material is referred to as a "paper", since the thickness thereof is similar to industrial papers and has in the past been made on paper-making machines.

The second element of the cryogenic insulation is a metal foil. These foils are quite thin and may be made of a variety of metals. However, the foil is often made of aluminum, since aluminum has a reflective surface and the foil is used as a radiation barrier in the cryogenic insulation.

While a number of methods are employed by the art in wrapping the paper and foil around the outer surface of the inner cryogenic tank in the more usual method, cryogenic insulation paper is unrolled from at least one roll thereof, and the paper is wrapped in serially disposed wraps around the inner tank. Likewise, cryogenic insulating metal foil is unrolled from at least one roll thereof, and the foil is serially wrapped onto the respective serial wraps of the paper. Multiple layers of such serial wraps are placed around the inner tank. In this regard, "serial wrap" means that a wrap around the outer surface of the inner cryogenic tank is placed substantially adjacent to a prior wrap and substantially adjacent to a succeeding wrap, as explained in more detail below.

In such wrapping, it is of substantial importance that the edges of a wrap of the metal foil do not contact edges of a preceding wrap of the metal foil or the edges of a succeeding wrap of the metal foil, and it is likewise important that the metal foil of a wrap in one layer does not contact the metal foil of a wrap in a preceding layer or a succeeding layer. If such contact occurs, heat may flow by conduction, either between metal foil wraps in the same layer or metal foil wraps in a preceding or succeeding layer. If heat can flow by conduction, then a "short" or "hot spot" occurs, and the insulation value at such "short" or "hot spot" is severely reduced. This is because the metal foil is intended to function as a radiation barrier in such cryogenic tank systems, and in order for that radiation barrier to be fully effective, such metal-to-metal contact of the metal foil must be avoided.

One of the most common methods in the prior art for wrapping the inner tank involves rotating the inner tank about its longitudinal axis while wrapping the tank with the paper unwound from a roll thereof and with metal foil unwound from a roll thereof. This is generally achieved by means of a pivot arm rotated about a central axis with a roll of the paper on each extremity of the pivot arm and a roll of the foil near each roll of paper. The pivot arm is rotated in a plane generally parallel to the longitudinal axis of the inner tank, while the inner tank is being rotated about that longitudinal axis.

By this arrangement, a wrap of paper is placed on the tank and a wrap of foil is placed on that wrap of paper to form one layer of wraps of a multi-layered insulation. Since there is a roll of paper and a roll of foil at each extremity of the pivoted arm, two combinations of foil and paper are simultaneously wrapped onto the rotating inner tank. The common prior art method may be referred to as the orbital method.

This prior art process, however, suffers from decided disadvantages. First of all, since each extremity of the pivot arm can carry only one paper roll and one foil roll, only two combinations of paper and foil, one at each extremity of the pivot arm, can be wrapped onto the outer surface of the inner tank during rotation of the inner tank. This results in a relatively slow and time-consuming wrapping procedure, which not only considerably slows production, but increases the cost of wrapping the cryogenic insulation around the inner tank.

Secondly, in order to avoid shorts or hot spots, as explained above, it is necessary to carefully control the wrap of the metal foil onto the wrap of the paper such that the foil of a wrap does not contact the foil of a preceding wrap or succeeding wrap or contact the foil of a preceding layer of wraps or a succeeding layer of wraps. This requires careful monitoring and control of the wrapping system.

While all of the above has long been known in the art, the art has not discovered methods for wrapping the inner tank in a manner which will both speed the wrapping of that inner tank and, at the same time, avoid the possibility of shorts or hot spots. It would, therefore, be of considerable advantage to the art to provide a method of wrapping cryogenic insulation around the inner tank where the speed of that wrapping can be considerably increased, e.g. at least doubled, and where the possibility of shorts and hot spots is essentially eliminated.

SUMMARY OF THE INVENTION

The present invention is based on several primary discoveries and several subsidiary discoveries.

First of all, it was discovered that the possibility of shorts or hot spots could be essentially eliminated by preassembly of the foil and paper into a combined form thereof. By such preassembly, the foil can be very accurately placed and essentially centered on the paper such that the possibility of shorts and hot spots can be essentially eliminated.

As a second primary discovery, it was found that, with such combined preassembly of cryogenic insulation, the usual method of unrolling the paper and the foil from separate rolls could be eliminated, and the combined preassembled cryogenic insulation of paper and foil could be substituted therefor. With the combined preassembled cryogenic insulation, instead of applying only one combined layer of paper and foil, e.g. from each end of the pivot arm in the orbital method as described above, at least two preassemblies of the cryogenic insulation can be disposed at each extremity of the pivot arm, thus allowing the application of two combined layers of paper and foil from each end of the pivot arm. This, therefore, at least doubles the wrapping speed of the cryogenic insulation around the inner tank when using that conventional wrapping apparatus. In this regard, by use of the foil properly centered on the paper, the speed of the pivot arm and the speed of rotation of the tank may be increased without concern of creating shorts or hot spots, thus further increasing the speed of wrapping.

As a secondary discovery, it was found that these preassemblies of paper and foil are most advantageous in the form of a generally circular roll thereof, and for conciseness herein, those preassemblies will be referred to as rolls, but it is to be understood that the shape of the preassemblies is not limited to roll form, but may be in other forms, e.g. layered form, and the term "roll" is to be so understood.

As another primary discovery, it was found that, with the combined roll of cryogenic insulation which has alternating layers of paper and foil, the paper may be of a defined first width and the foil may be of a defined second width, where the second width is less than the first width. By such an arrangement, edge portions at each edge of the paper are not contacted by the foil, and these edge portions of the paper can avoid edge-to-edge contact of the metal foil between adjacent wraps or contact of metal foil between adjacent layers of wraps.

As another secondary discovery, because the paper extends beyond the foil, the foil is protected from edge damage. In this regard, since the foil is quite thin, e.g. has a thickness of as low as 0.00025 inch, for the reasons explained hereinafter, edge damage, e.g. even a slight nick, can create a tear fault at the edge of the foil. Such a tear fault at the edge of the foil can cause the foil to tear when being formed into the combined roll or when being unwound from such combined roll, as explained more fully hereinafter. Such a tear causes breakage of the preassembly of foil and paper and is unacceptable.

As a further primary discovery, it was found that if the foil is substantially centered on the paper so that those edge portions of the paper are known and maintained, then the wrapping speed can be increased by increased rotation of the pivot arm and inner tank to a speed consistent with the accuracy of the particular wrapping machine, i.e. the accuracy of the particular machine to wrap a succeeding wrap within a known tolerance of displacement from a preceding wrap. This tolerance can then be correlated to the difference in the defined first and second widths to ensure that hot spots or shorts are essentially eliminated.

As a further primary discovery, it was found that the combined roll of cryogenic insulation could be prepared by providing a roll of paper on a paper-holding shaft, a roll of foil on a foil-holding shaft, unrolling a length of the paper and a length of the foil, and centering the length of the foil on the length of the paper to provide a combined layer of paper and foil. That combined layer is then attached to a removable core disposed on a core shaft and the assembled combined layers are driveable at selected speeds. By engaging an adjustable tension control for the paper and the foil, correct tensions can be applied to the paper and foil so that those two may be wound onto the removable core by driving the combined layers, e.g. by driving a core shaft. In order to maintain that centering of the foil on the paper, however, at least one of the paper-holding shaft or paper and the foil-holding shaft or foil may be laterally adjustable, e.g. translatable, so as to adjust the centering of the foil on the paper.

As a subsidiary discovery in this regard, it was found that the centering of the foil on the paper should be maintained within a tolerance of about at least 0.1 inch, especially about 0.04 inch, from the true center. Maintaining such tolerance ensures that hot spots or shorts are essentially eliminated.

As another primary discovery, it was found that an apparatus could be constructed for carrying out the foregoing process, which apparatus has a paper-holding shaft, a foil-holding shaft, a shaft for holding a removable core, an attachment means for attaching a combined length of the paper and foil to the removable core, a tension control means, an adjustable means, e.g. a translating means, and a drive means for driving assembled layers or the core shaft.

Accordingly, very briefly stated, the present invention, in one aspect, is concerned with an improved method of wrapping cryogenic insulation around an inner tank disposable within an outer tank of a cryogenic tank system. The prior art method comprised unrolling cryogenic insulation paper from at least one roll thereof, wrapping the paper in serially disposed wraps around the inner tank, unrolling the cryogenic insulating metal foil from at least one roll thereof, and wrapping the foil in serially disposed wraps onto the respective serial wraps of the paper.

The present improvement in that process is where at least one combined roll of cryogenic insulation is provided. That combined roll has alternating combined layers of the paper of a defined first width and foil of a defined second width which is less than the defined first width, wherein the foil is centered on the paper so as to provide edge portions at each edge of the paper which are not contacted by the foil. Lengths of combined layers of paper and foil are unrolled from the combined roll, and those lengths of combined layers are wrapped in serially disposed wraps around the inner tank.

In another aspect of the invention, there is provided a combined roll of cryogenic insulation. That combined roll comprises alternating layers of cryogenic insulation paper of a defined first width and metal foil of a defined second width which is less than the defined first width. The foil is centered on the paper so as to provide edge portions at each edge of the paper which are not contacted by the foil.

In another aspect of the invention, a method is provided for producing the combined roll of cryogenic insulation. In this method, a roll of paper is provided on a paper-holding shaft, a roll of foil is provided on a foil-holding shaft, and a length of paper and length of foil are unrolled from each. The length of foil is centered on the length of paper to provide combined alternating layers thereof. The combined layers are attached to a removable core disposed on a core shaft and the assembled layers are driveable at selected speeds, e.g. by driving the core shaft. An adjustable tension control is engaged for both the paper, e.g. engaging the paper-holding shaft, and the foil, e.g. the foil-holding shaft. At least one of the paper, or paper-holding shaft, and the foil, or foil-holding shaft, are laterally adjustable, e.g. translatable to adjust the centering of the foil on the paper. The assembled layers are driven at selected speeds of rotation, e.g. by driving the core shaft at selected speeds of rotation, until a selected linear amount of the combined layers are wound onto the removable core as a roll of cryogenic insulation.

As yet a further aspect of the invention, an apparatus is provided for producing the combined roll of cryogenic insulation. The apparatus comprises a paper-holding shaft for holding a roll of the paper, a foil-holding shaft for holding a roll of the foil, and a core shaft for holding a removable core. Attachment means are provided for attaching a combined length of paper and foil to the removable core. Tension control means are provided for controlling the tension of the paper, e.g. the tension of the paper-holding shaft, and the foil, e.g. the tension of the foil-holding shaft. Adjusting means, e.g. translating means, are provided for laterally adjusting at least one of the paper, or the paper-holding shaft, and the foil, or the foil-holding shaft, such that the foil is centerable on the paper in the combined length of paper and foil. A drive means is provided for driving the assembled layers, e.g. for driving the core shaft, at a selected speed of rotation and winding the combined layers onto the removable core.

In briefly describing the invention, above, the terms roll, shaft, core, speeds of rotation and the like imply that the paper, foil and preassembled combined layers are in the physical form of rolls, which, as noted above, is a preferred form of the invention, but these terms have been used above and hereinafter only for conciseness purposes. These terms should not be understood to limit the invention to circular-like forms but should be understood to embrace equivalent forms, such as the "fan" form of continuous printer paper and the like, and these terms should be understood to embrace the equivalent structures for transporting and assembling of such forms.

DESCRIPTION OF PREFERRED EMBODIMENTS

Figure 1:
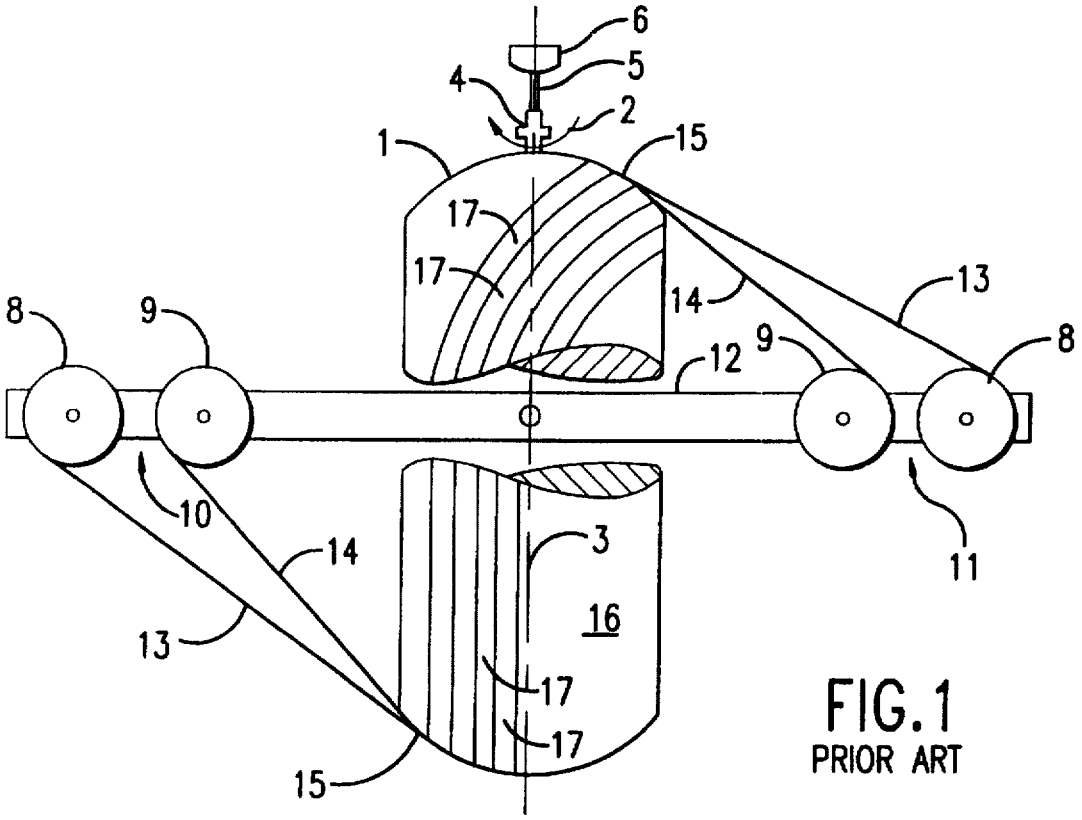
FIG. 1 PRIOR ART
FIG. 1 is a diagrammatic illustration of a conventional prior art machine for wrapping separate rolls of paper and metal foil on an inner tank of a cryogenic tank system.

Cryogenic insulation is a very specialized insulation which requires very special properties. As opposed to usual insulation, cryogenic insulation must be capable of operating at very low temperatures, i.e. cryogenic temperatures between about −130° F. and −450° F., while retaining functionality, especially flexibility, at those temperatures. Also, as noted briefly above, the accuracy of the wraps on the inner tank is most important, and the metal foil/paper properties, especially tensile strength, are important in so effectively controlling the position of the wraps on the inner tank so as to avoid shorts and hot spots. Finally, the insulation must provide an effective radiation barrier. These very special requirements for cryogenic insulation have led to a very restrictive list of materials which can qualify as cryogenic insulation.

In this latter regard, as noted above, cryogenic insulation is made up of a paper and a foil, with the foil acting as the radiation barrier. The paper forms an insulation and also spaces apart the foil such that shorts and hot spots do not occur and the foil can function as a radiation barrier.

While there is some latitude in the fibers which make up the paper, the paper must be flexible so as to be accurately wrapped onto the inner tank. The fibers must retain the felting properties of the insulation at cryogenic temperatures. These requirements mean that the fibers are usually chosen from a limited group of fibrous material. While natural inorganic fibrous material, such as asbestos, has been used in the past, and while by-product inorganic fibrous material, such as spun slag, has also been used in the past, neither of these materials, or other like inorganic materials, are fully satisfactory for present purposes. In the present invention, while the paper is made of a fibrous material, as in the prior art, that fibrous material, in combination with the foil, must be capable of retaining the felt-like structure of insulation even at the present greater wrapping speeds and at the present speeds of forming the combined rolls. Thus, the paper should have a thickness of about 0.0025 inch to about 0.0035 inch to ensure both sufficient strength of the paper to make a combined roll of the foil and paper, to ensure sufficient flexibility for wrapping onto the inner tank of a cryogenic tank system and to ensure the above-noted functionalities at cryogenic temperatures.

To meet these requirements, therefore, it is preferred that the fibrous material is a microfiberglass, and it is most preferred that the microfiberglass is a borosilicate glass. While there is some latitude in the diameter of the glass, especially when the microfiberglass is a borosilicate glass, it is preferred that the microfiberglass have an average diameter range of from between about 0.3 to 10 microns, especially about 0.5 to 4 microns, e.g. about 0.75 to 1.5 microns.

The fiber length should also be short, e.g. less than about 2 millimeters, especially less than 1 millimeter, e.g. between 0.1 and 1 millimeter.

While certain organic fibers, e.g. polyester fibers, can function in cryogenic application, usually combustible organic fibers are not used since cryogenic tanks often contain combustible liquified gases.

Likewise, in the prior art, there is some latitude for the metal foil of the cryogenic insulation. While copper, brass, stainless steel and the like have been suggested in the prior art, since the combined roll of cryogenic insulation, according to the present invention, is a preassembled roll, as briefly explained above, it has been found that these other prior art suggested materials are not entirely satisfactory and that the foil is most preferably aluminum foil. When the aluminum foil has a thickness of from about 0.00025 inch to about 0.0015 inch, the foil has both the strength and flexibility to form the present combined roll, to be unwound from that combined roll for wrapping an inner tank of a cryogenic tank system without difficulty, breaking, tearing, wrinkling or the like and to function at cryogenic temperatures. This is particularly true where the aluminum foil has a "0" temper.

It will be appreciated that since the foil functions in part as a radiation barrier that foil must be substantial continuous over the surface of the inner tank and it is intended that the foil forms a curved planar surface over the inner tank. Thus, if the foil is wrinkled that curved planar surface will not result. If the foil is broken, however, a more serious problem is involved, since either operation must be stopped. As noted above, the tensile strength of the foil/paper is important to accuracy of wraps on the inner tank, but as also noted above the paper is a felt-like structure and has a thickness of as little as 0.0025 inch. Thus, the paper has relatively low tensile strength and the foil of the foil/paper assembly must carry most of the tensile load in forming a combined roll and in unwinding that combined roll for wrapping an inner tank. Accordingly, if the foil breaks during either of these operations, the foil/paper assembly is likely to break and such breakage will cause a disruption of either operation. In the prior art, where the paper and foil were separately wrapped onto the tank, as explained above, foil breakage is a problem because of edge damage to the foil during handling or wrapping of the foil. Such edge damage, even small nicks, can cause a tear fault in the foil which will allow tearing of the foil during wrapping. This difficulty is essentially eliminated by the present invention that the paper extends beyond the foil and the foil is protected from such edge damage.

Thus, for purposes of the present invention, the paper and foil of the cryogenic insulation are relatively critical, and care must be observed in selecting materials to meet the requirements of the present invention, as explained in more detail below.

FIG. 1 shows, in diagrammatic form, the basic steps of the prior art orbital method of wrapping the outside of an inner tank of a cryogenic tank system. As shown in FIG. 1, the inner tank 1 of a cryogenic tank system is rotated, as indicated by arrow 2, about its longitudinal axis 3, usually by suspending tank 1 from a coupling 4 and a shaft 5 driven by a motor 6.

As tank 1 rotates about its longitudinal axis 3, a roll of paper 8 and a roll of foil 9 disposed at each extremity 10 and 11 of a pivoting arm 12 are unwound into lengths 13 and 14, respectively, which are wrapped at 15 on the surface 16 of tank 1. By common rotation of pivot arm 12 and tank 1, the wraps 17 are placed in a serial manner on the surface 16 of tank 1. It will be noted from FIG. 1 that the wraps of the orbital method are generally "pole" to "pole" wraps, i.e. generally from one dome of the inner tank to the other dome thereof, as opposed to generally serial circumferential wraps used in other known methods. This, of course, is necessary to also wrap the domes, but also makes the wrapping, and especially the accuracy thereof, more difficult.

As can be appreciated from FIG. 1, care must be taken such that the application of the length of foil 14 to the paper 13 is so centered on the paper at contact point 15 that a short or hot spot will not occur, as explained above.

Figure 2:
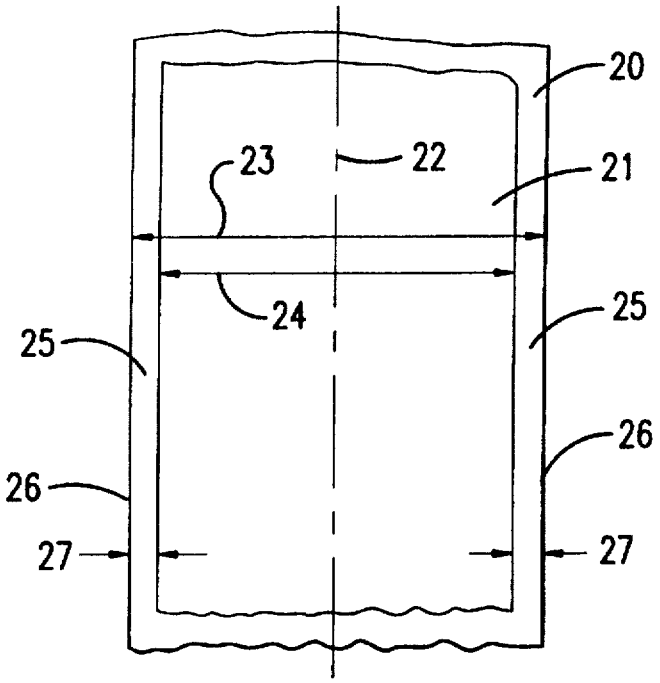
FIG. 2 is a top view of combined paper and foil according to the present invention.

In this regard, FIG. 2 is a top view of a section of paper 20 having a section of foil 21 applied thereto according to the present invention. The center line 22 of paper 20 should essentially bisect both the width 23 of paper 20 and the width 24 of foil 21. The defined width 24 of foil 21 is less than the defined width 23 of paper 20. Thus, when the foil 21 is centered on the paper 20, edge portions 25 at each edge 26 of paper 20 are provided which are not contacted by foil 21.

While there is some latitude in the size of the edge portion, in order to ensure that serial wraps may be employed without encountering shorts or hot spots, and to ensure protection of the edges of the foil from edge damage, each edge portion 25 should have an edge width 27 equal to from 3% to 25% of the width 23 of paper 20.

Since the intention of the present invention is to allow use of existing wrapping machines with the present combined rolls, the width of the edge portion should accommodate the varying accuracy of wraps deployed by those existing machines. Some existing machines are more accurate in this regard than others. Very accurate machines could, therefore, use combined rolls where the edge portion 25 has an edge width 27 equal to only about 3% of the width 23 of paper 20, while somewhat inaccurate existing machines may require up to 25% to ensure that hot spots and shorts are eliminated.

Figure 3A:
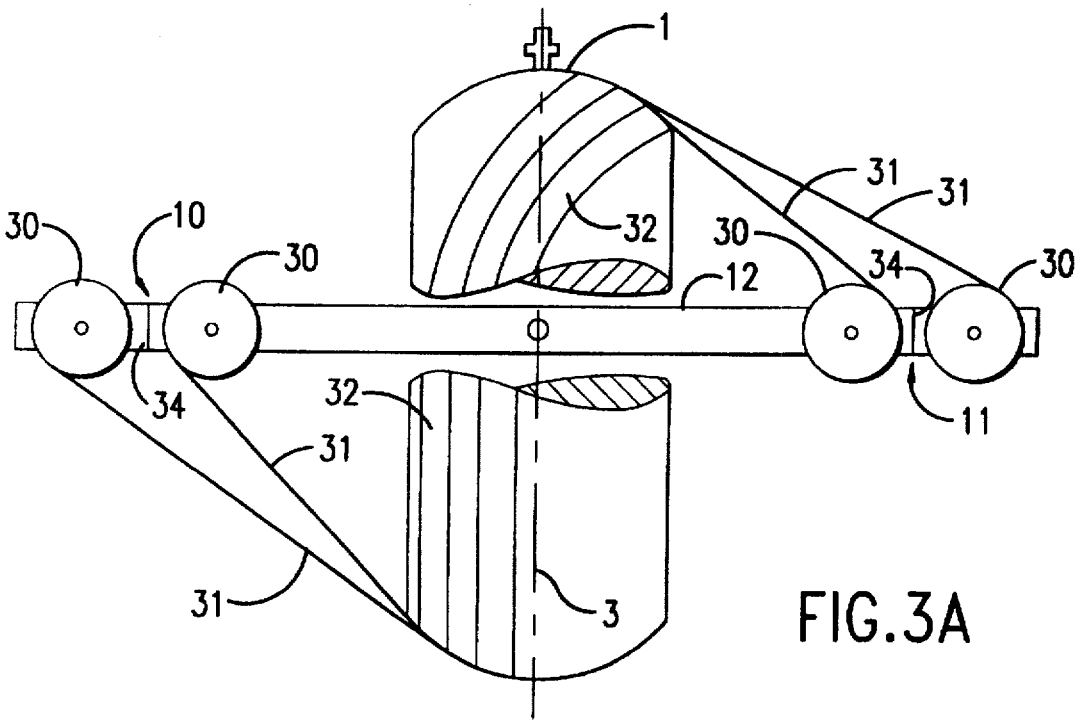
FIGS. 3A, 3B and 3C are diagrammatic illustrations of the machine of FIG. 1 as modified to use the combined paper and foil of FIG. 2.

With such arrangement of the paper and foil in the combined roll, instead of the arrangement shown in FIG. 1, all of paper rolls 8 and foil rolls 9, shown in FIG. 1, can be substituted by a combined roll of the present invention, as shown in FIG. 3A. Thus, instead of rolls 8 and 9 of FIG. 1, as shown in FIG. 3A, four combined rolls 30 are used. This doubles the speed of wrapping of the inner tank 1, even if the speed of rotation of tank 1 or the speed of rotation of pivot arm 12 is not increased. However, since the foil 21 (see FIG. 2) is accurately placed on paper 20 with the prescribed edge portions 25, it can be ensured that shorts and hot spots can be essentially eliminated. Thus, both the speed of rotation of tank 1 and the speed of rotation of pivot arm 12 can be increased, such that the speed of wrapping can be increased more than two times, e.g. 2½ or 3 times, when combined rolls 30 (see FIG. 3A) are simply substituted on conventional apparatus for paper rolls 8 and foil rolls 9 (see FIG. 1). However, since the combined rolls have the foil accurately placed on the paper, more than four combined rolls 30 (see FIG. 3A) may be used, e.g. six. While six combined rolls would increase the alignment problem for serially placing each wrap beside adjacent wraps, such control is well within the skill of the art.

As can be appreciated, since rolls 30 are combined rolls and the wraps 32 on tank 1 from each roll 30 will be disposed next to a preceding wrap 32, a different disposition of wraps 32 (see FIG. 3A) must be made from that of wraps 17 in FIG. 1. This is because, in FIG. 1, foil 14 from roll 9 is intended to be wrapped onto paper 13 from roll 8, as opposed to FIG. 3A where each wrap is disposed next to a preceding wrap. To achieve this different disposition of wraps 32, as shown in FIG. 3A, pivot arm 12 and/or the rolls are arranged such that each of rolls 30 are staggered with respect to each other in a direction perpendicular to center line 3 of tank 1 by a staggered configuration at the extremities 10 and 11 of pivot arm 12. That staggering may be arranged as shown in FIG. 3A by the staggered edges 34 and shown specifically in FIG. 3B in connection with extremity 11. Of course, extremity 10 will be staggered in the opposite direction or at different stagger depths (not shown). Alternatively, that staggering may be achieved as shown in FIG. 3C, again with opposite stagger directions or depths.

Figure 3B:
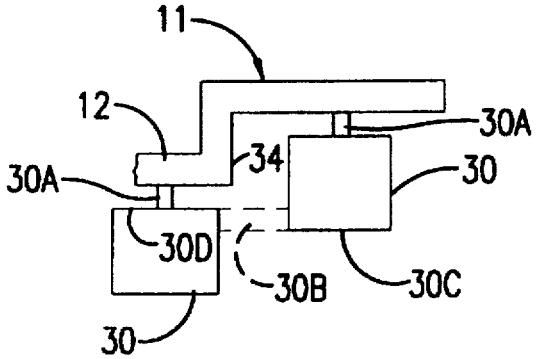
Figure 3C:
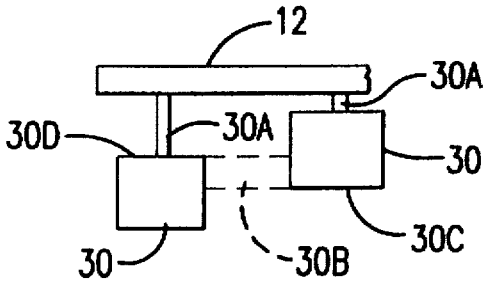

In regard to both FIGS. 3B and 3C, it will be seen that the two rolls 30 are offset from each other, e.g. staggered, and supported by roll-holding shafts 30A. In FIG. 3B, the roll-holding shafts 30A are essentially of equal length and the staggering is achieved by the offset at extremity 11 of arm 12, while in FIG. 3C, the arm 12 is not offset and the staggering is achieved by the different lengths of roll-holding shafts 30A. However, in both, there is an overlap 30B between a forward edge 30C and a rearward edge 30D, with the overlap in FIG. 3C being greatly exaggerated for clarity purposes. The purpose and extent of this overlap is explained below in connection with FIG. 4.

As noted above, while the term "roll" is used herein for conciseness in regard to the present preassemblies of paper and foil, those preassemblies could be in any layered form. For example, layers of paper and foil in "fan" form, as computer paper is configured and fed from a box thereof, instead of a shaft, may be used. Likewise, forms other than circular rolls may be used to feed the paper and foil for forming the combined "rolls" thereof. Thus, the term "roll" as used herein is to be so understood, but it far preferable that the form be an actual roll form for convenience of handling.

As lengths of combined layers 31 (see FIG. 3A) are unrolled from combined rolls 30, those lengths of combined layers 31 are wrapped in serially disposed wraps 32 around inner tank 1 as that tank is rotated about its longitudinal axis 3. As can be appreciated, however, with such serial wrapping technique, the width 23 of paper 20 (see FIG. 2) must be chosen to accommodate the particular size and configuration of tank 1 as well as the number of combined rolls 30 (see FIG. 3A) used for wrapping the tank. Depending upon the size of the tank and the number of combined rolls used, it has been found that the width of the paper should be from about 1 inch to about 12 inches, preferably from about 3 inches to about 9 inches, and most preferably about 6 inches in width. Of course, the combined roll can be made in much wider widths for very large tanks, e.g. up to 200 inches, e.g. 105 inches. Also, such very wide rolls may be produced and then split in a conventional manner removing the appropriate edge portions of the foil to produce combined rolls of the foregoing smaller widths.

Figure 4:
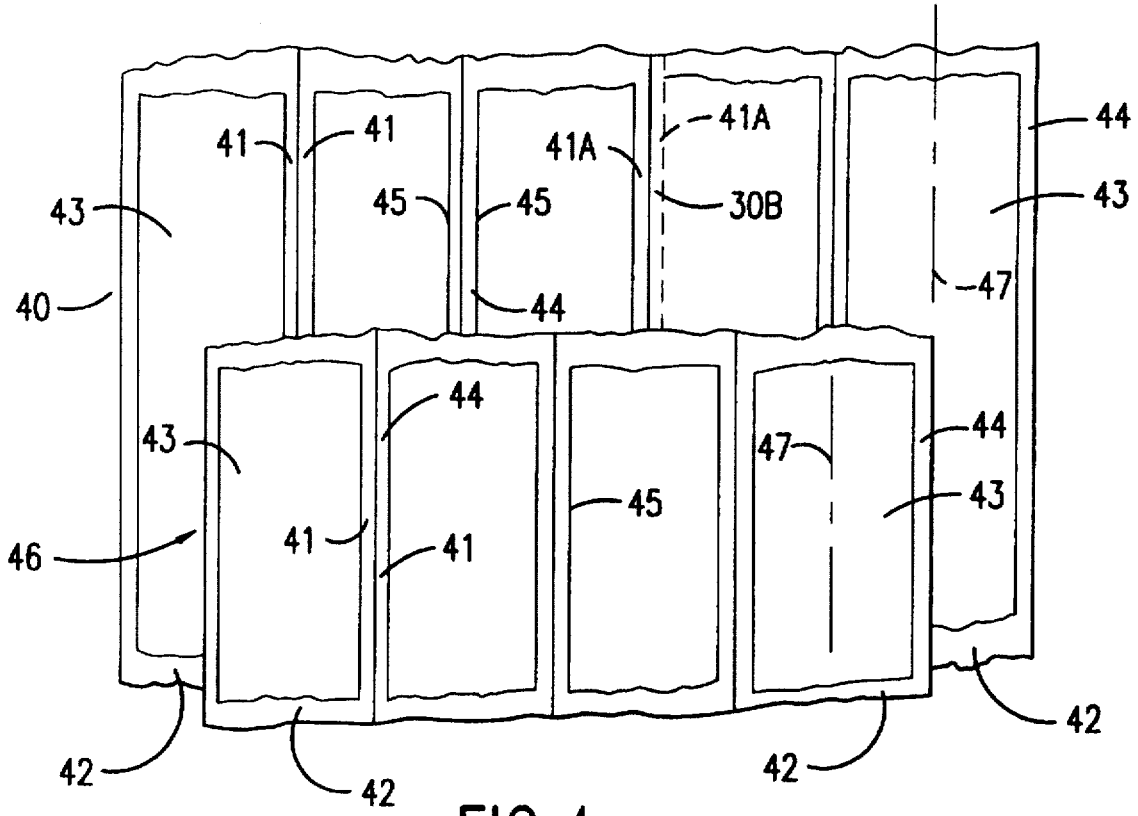
FIG. 4 is a top view of two layers of combined paper and foil.

FIG. 4 is a diagrammatic illustration of serial wraps. It will be understood that in wrapping a cylindrical tank, especially with a domed top and a domed bottom, the wraps will not be planar, as depicted in FIG. 4. However, that planar depiction is used in FIG. 4 for clarity purposes.

In FIG. 4, there are a series of serial wraps, generally, 40 with edges 41 placed at each adjacent wrap. Each wrap consists of insulating paper 42 with metal foil 43 centered thereon, i.e. maintained within a tolerance of at least about 0.1 inch, especially about 0.04 inch, from the true center line. Each edge portion 44 may substantially abuts an edge portion of an adjacent wrap. In this regard, as can be easily appreciated, an exact abutment of edges 41 would require very accurate placement of the wraps, and some existing machines are not that accurate. Thus, often, and usually preferably, an edge 41 of a succeeding wrap will slightly overlap an edge 41 of a preceding wrap, as shown by some of edges 41A having the overlap 30B (see FIGS. 3B and 3C). This overlap ensures that no substantial space will exist between succeeding wraps so as to avoid areas of less than intended insulation and is, therefore, a preferred embodiment. Thus, while edge portions 44 may somewhat overlap, that overlap should not be to the extent that edges 45 of the foil 43 contact each other. The overlap can vary from as little as about 10% of the edge portion 44 to as great as about 90% of the edge portion 44, but preferably the overlap will be about 20% to 60%.

The serial wraps, generally 40, constitute one layer of wrap on a cryogenic inner tank. A plurality of additional layers of wrap, e.g. 2 to 150 or more, generally, 46 are applied thereover with, again, the same arrangement of edge portions 41 and/or 41A of paper 42, the foil 43 being centered on paper 42, and the paper 42 having the same edge portion 44, where the edges 45 of foil 43 do not contact one another. While not necessary, it is preferable that the center lines 47 of the wraps in the two layers 40 and 46 (or additional layers) are offset from each other, and more preferably offset by up to about one-half of the width of the paper 42. The technology for producing such wraps is well known in the art and need not be described herein in detail.

Figure 5:
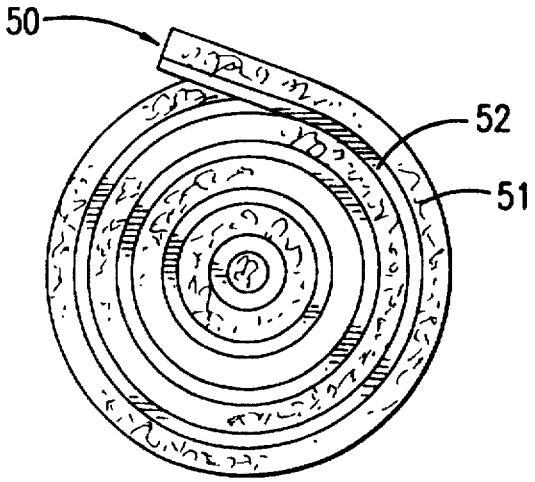
FIG. 5 is a side view of a roll of the combined paper and foil.

FIG. 5 diagrammatically shows a combined roll of the cryogenic insulation in the preferred actual circular roll form. That combined roll comprises alternating layers, generally, 50 of cryogenic insulation paper 51 of a defined first width, as illustrated in FIG. 2, and metal foil 52 of a defined second width, as illustrated in FIG. 2, which defined second width is less that the defined first width. The foil is also centered on the paper, as shown in FIG. 2, so as to provide the edge portions 25 of each edge 26 of the paper, which edge portions are not contacted by the foil.

With such actual roll form, the layers of paper and foil will be adequately held together by mutual friction such that one layer will not be displaced relative to the other. If other than actually roll form is used, e.g. a "fan" form, a tacking of the two layers together may be required, e.g. by use of dots of glue, depending on the particular form of the assembly, the particular metal foil and the particular paper.

As noted above, the paper of the actual roll is made of fibrous material and preferably has a thickness of about 0.0025 inch to about 0.0035 inch and, again, the fibrous material is preferably microfiberglass, preferably borosilicate glass and of a diameter range, as described above. Also, again, the foil of the actual roll is preferably aluminum foil with, preferably, a thickness of 0.00025 inch to about 0.0015 inch and has a "0" temper (no temper). Likewise, as shown in FIG. 2, each edge portion 25 has an edge width 27 equal to from 3% to 15% of the width of the paper.

Figure 6:
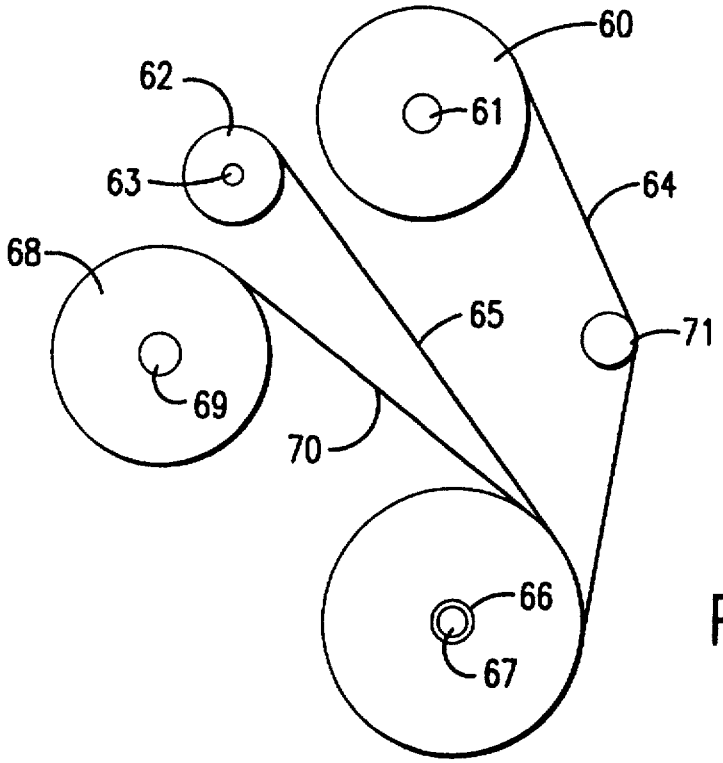
FIG. 6 is a diagrammatic illustration of apparatus for producing the combined roll of paper and foil of FIG. 5.

The method of producing the combined roll is diagrammatically illustrated in FIG. 6. The steps of that method are providing a roll of paper 60 on a paper-holding shaft 61 providing a roll of foil 62 on a foil-holding shaft 63 and unrolling a length of paper 64 and a length of foil 65. The length of foil 65 is centered on the length of paper 64, as explained above in connection with FIG. 2, to provide the combined layers of paper and foil.

The combined layers are attached to a removable core 66 by either a mechanical attaching means, e.g. a spring clip, or simply taping the combined layers to the removable core with conventional adhesive tape. The removable core 66 is disposed on a core shaft 67 which is driveable at selected speeds by a conventional motor (not shown in FIG. 6). An adjustable tension control (shown in FIG. 7 and discussed hereinafter) is engaged for the paper-holding shaft 61 and for the foil-holding shaft 63.

Figure 8:
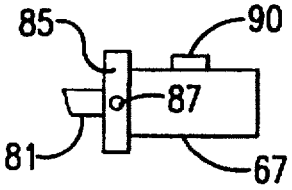
FIG. 8 is a side view of a removal core and attachment means.

At least one of the paper-holding shaft 61 and the foil-holding shaft 63 is laterally adjustable, e.g. translatable, (as shown in FIG. 8 and discussed below) to adjust the centering of the foil on the paper, as shown in FIG. 2. The core shaft 67 is driven by a motor (not shown in FIG. 6) at a selected speed of rotation until a selected linear amount of the combined layers (see 50 of FIG. 5) is wound onto the removable core 66 as a roll of cryogenic insulation, as shown in FIG. 5.

While not required, the method may also include the use of a second paper roll 68 disposed on a second paper roll shaft 69 which will, of course, cause a sandwiching of foil 65 between the paper 64 from the first paper roll 60 and the paper 70 from the second paper roll 68.

Figure 7:
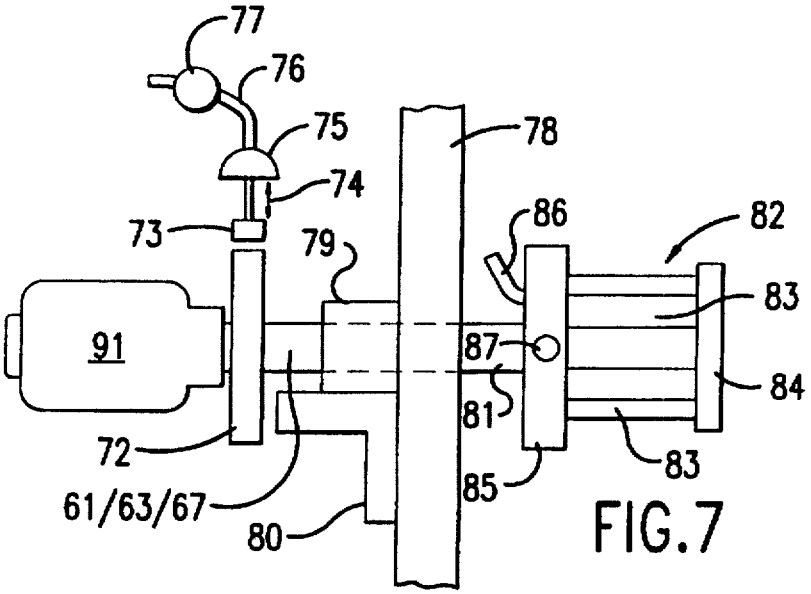
FIG. 7 is a side view of a portion of the apparatus of FIG. 6, showing a suitable tension device and air chuck.

While any suitable braking system may be used for providing the adjustable tension control, mentioned above, e.g. friction brakes, fluid brakes, disc brakes, caliper brakes, drum brakes and the like, a simple and suitable device is shown in FIG. 7. As can be seen from FIG. 7, on the back of at least paper-holding shaft 61 and foil-holding shaft 63, but also preferably at the back of core shaft 67, a brake drum (steel) 72 is disposed. A curved brake pad (radius of curvature being the same as the radius of the steel brake drum) 73 is moveable as shown by arrow 74 into or out of engagement with drum 72 by means of an air motor 75 supplied with compressed air through pipe 76. The pressure of the air and hence the engagement of pad 73 against drum 72 is controlled by pressure control valve 77. These air brakes are commercially available, and a number of variations thereof are also available. Model J and Model K diaphragm brakes, for example, made by the Horton Company are satisfactory.

As also shown in FIG. 7, shaft 61/63/67 is supported by a frame member 78 of the machine and is so supported by a bearing journal 79 attached to a bracket 80, which in turn, is attached to frame member 78 by suitable attachment means (not shown), e.g. bolts, welds, screws, etc.

At the other end 81 of shaft 61/63/67 is a conventional air chuck, generally 82, having leaves 83 attached at each end thereof to bearing collar 84 and collar 85. Compressed air passes through pipe 86 into an internal bladder (not shown) to expand leaves 83 and tightly secure a roll or core 60/62/66/68 (see FIG. 6) thereto.

Air chuck 82 is manually adjustable along the longitudinal center line of shaft 61/63/67, i.e. translatable, by means of set screw 87 passing through bearing collar 85 and contacting shaft 61/63/67. The position along that shaft can be adjusted by manually loosening set screw 87, sliding air chuck 82 and retightening set screw 87. Alternatively, other conventional adjusting devices may be used, e.g. worm screws, friction positioned shafts, slide tables and the like. All of these may be electrically or electronically controlled, e.g. with electric eyes, infrared or television cameras, friction sensors and the like, but the simple device described above is quite adequate.

As shown in FIG. 6, a linear counter 71, which can be a conventional rotating linear counter, can determine the linear amount of combined layers wound onto the removable core. It is preferable to keep a close count of the linear amount wound onto the removable core, so that each combined roll of material will have essentially the same amount of combined layers thereon. This will allow the wrappings of the inner tank to run out of the combined layer on the combined rolls at about the same time. A conventional counter may be used, e.g. a friction wheel counter, a pulse counter and the like.

The apparatus for producing the combined roll of cryogenic insulation is also diagrammatically illustrated in FIGS. 6, 7 and 8. As shown in those figures, the apparatus comprises a paper-holding shaft 61 for holding a roll of paper 60, a foil holding shaft 63 for holding a roll of foil 62 and a core shaft 67 for holding a removable core 66. An attachment means 90 is shown in FIG. 8 for attaching either an end of the paper or an end of the foil or a combined length of paper and foil to, respectively, shafts 61 and 63 or core 67 (core 67 being shown in FIG. 8). The attachment means may be simply a conventional spring-clip attachment device, which is well known in the art, or it may simply be tape holding the paper, foil or combined length of paper and foil to those respective shafts and/or removable core 67.

The drive means of the apparatus is shown in FIG. 7 as a conventional electrical motor 91. That drive means drives the core shaft 67 at selected speeds of rotation so as to wind the combined layers onto the removable core 67. The drive means may also be associated with shafts 61 and 63, as well as shaft 69 when used, as shown in FIG. 6, although that is not required.

It will be readily apparent from the above that the description of the shafts, drives therefor, translation devices and tension devices illustrates simple embodiments, which are preferred, but that these simple embodiments are amenable to a wide variety of obvious variations. Quite obviously, instead of driving the shafts, one or more of the rolls themselves may be driven the translation for adjustment of the centering of the foil on the paper need not be by translation of the shafts but may be by means of guide translations of the paper and/or foil themselves.

The invention will now be illustrated by the following example, although it is to be understood that the invention is not limited to this specific example but extends to the foregoing disclosure and to the spirit and scope of the annexed claims.

EXAMPLE

An apparatus as shown in FIGS. 6, 7 and 8, but without shaft 69 and roll 68, was used in this example. The aluminum foil used is an aluminum 1145 alloy with 99.45% aluminum and 0.55% silicon and iron. The thickness of the foil was 0.001 inch, and the foil had a "0" temper, which signifies that it is a soft foil.

The paper was 100% borosilicate microfiberglass, and the paper had a thickness of 0.003 inch. The paper is produced by Lydall Manning Nonwovens under the trademark CRYOTHERM®. The microfiberglass had an average diameter range of about 0.75 to 1.5 microns.

A length of the paper 64 and a length of the foil 65 were gathered and centered by hand onto removable core 66 disposed on shaft 67. The layers of foil and paper were attached to the removable core by way of tape. Shaft 63 was hand translated with the mechanism shown in FIG. 7 for carefully adjusting the centering of the foil onto the paper. Thereafter, the electrical motor 91 was energized to drive shaft 67, and the counter 78 was engaged (see FIG. 6) to measure the amount of combined layers wound onto the removable core. When that operation of the winding had commenced and was at steady state, the centering of the foil on the paper was periodically checked to ensure that the centering remained true.

About 1,000 feet of the combined layers was wound onto removable core 66, and the winding was then discontinued.

A sample of the combined layers was tested for thermal performance at vacuum levels in the range of $10^{-5}$ to $10^{-6}$ TORR and resulted in a heat flux of 0.5 to 0.10 Watts/$M^2$. The testing was conducted from 4° to 80° K temperature range.

Similar product was produced and wound on a conventional inner tank of the cryogenic tank system, with the apparatus shown in FIG. 3A using four rolls of the combined layers of cryogenic insulation. The tank was inspected for thermal shorts and hot spots, and none were detected. The winding speed of the tank with the combined rolls was twice that of the conventional winding speed using separate rolls of aluminum foil and paper, as shown in FIG. 1.

What is claimed is:

1. In a method of wrapping cryogenic insulation around an inner tank disposable within an outer tank of a cryogenic tank system comprising unrolling cryogenic insulation paper from at least one roll thereof, wrapping the paper in serially disposed wraps around the inner tank, unrolling cryogenic insulating metal foil from at least one roll thereof and wrapping the foil in serially disposed wraps onto respective serial wraps of the paper, the improvement comprising:

(1) providing at least one combined roll of cryogenic insulation having alternating combined layers of the paper of a defined first width and foil of a defined second width wherein the defined second width is less than the defined first width and the foil is centered on the paper so as to provide edge portions at each edge of the paper which are not contacted by the foil (2) unrolling from the combined roll lengths of combined layers; and (3) wrapping the lengths of combined layers in serially disposed wraps around the inner tank.

2. The method of claim 1, wherein the paper is made of fibrous material and has a thickness of about 0.0025 inch to about 0.0035 inch.

3. The method of claim 2, wherein the fibrous material is microfiberglass.

4. The method of claim 3, wherein the microfiberglass is a borosilicate glass.

5. The method of claim 4, wherein the microfiberglass has an average diameter in the range of 0.3 to 10 microns.

6. The method of claim 1, wherein the foil is aluminum foil.

7. The method of claim 6, wherein the aluminum foil has a thickness of from about 0.00025 inch to about 0.0015 inch.

8. The method of claim 7, wherein the foil has a 0 temper.

9. The method of claim 1, wherein each edge portion at each edge of the paper has an edge width equal to from 3% to 25% of the width of the paper.

10. The method of claim 9, wherein the width of the paper is from about 1 inch to about 12 inches.

11. The method of claim 1, wherein the inner tank is rotated about a longitudinal axis thereof while being wrapped with the combined layers.

12. A combined roll of cryogenic insulation, comprising alternating layers of cryogenic insulation paper of a defined first width and metal foil of a defined second width which is less than the defined first width, said foil being centered on the paper so as to provide edge portions at each edge of the paper which are not contacted by the foil.

13. The cryogenic insulation of claim 12, wherein the paper is made of a fibrous material and has a thickness of about 0.0025 inch to about 0.0035 inch.

14. The cryogenic insulation of claim 13, wherein the fibrous material is microfiberglass.

15. The cryogenic insulation of claim 14, wherein the microfiberglass is a borosilicate glass.

16. The cryogenic insulation of claim 15, wherein the microfiberglass has an average diameter in the range of 0.3 to 10 microns.

17. The cryogenic insulation of claim 12, wherein the foil is aluminum foil.

18. The cryogenic insulation of claim 17, wherein the aluminum foil has a thickness of from about 0.00025 inch to about 0.0015 inch.

19. The cryogenic insulation of claim 18, wherein the foil has a 0 temper.

20. The cryogenic insulation of claim 12, wherein each edge portion at each edge of the paper has an edge width equal to from 3% to 25% of the width of the paper.

* * * * *